US010132602B2

(12) United States Patent
McGuire et al.

(10) Patent No.: US 10,132,602 B2
(45) Date of Patent: Nov. 20, 2018

(54) LIGHTWEIGHT MUNITION

(71) Applicant: Aerojet Rocketdyne, Inc., Sacramento, CA (US)

(72) Inventors: Nicholas McGuire, Sacramento, CA (US); Roderick Daebelliehn, Sacramento, CA (US); Gregory Martin, Sacramento, CA (US)

(73) Assignee: AEROJET ROCKETDYNE, INC., Rancho Cordova, CA (US)

( * ) Notice: Subject to any disclaimer, the term of this patent is extended or adjusted under 35 U.S.C. 154(b) by 0 days.

(21) Appl. No.: 15/125,591

(22) PCT Filed: Mar. 19, 2015

(86) PCT No.: PCT/US2015/021368

§ 371 (c)(1),
(2) Date: Sep. 13, 2016

(87) PCT Pub. No.: WO2015/187232

PCT Pub. Date: Dec. 10, 2015

(65) Prior Publication Data

US 2017/0016704 A1 Jan. 19, 2017

Related U.S. Application Data

(60) Provisional application No. 61/968,092, filed on Mar. 20, 2014.

(51) Int. Cl.
*F42B 12/16* (2006.01)
*F42B 12/20* (2006.01)
(Continued)

(52) U.S. Cl.
CPC ..... *F42B 12/208* (2013.01); *F42B 3/16* (2013.01); *F42B 12/16* (2013.01); *F42B 12/76* (2013.01)

(58) Field of Classification Search
CPC ..... F42B 12/16; F42B 12/20; F42B 12/208; F42B 12/76; F42B 3/16
(Continued)

(56) References Cited

U.S. PATENT DOCUMENTS 4,803,928 A * 2/1989 Kramer ..... F42B 12/16 102/306
5,003,883 A * 4/1991 Mixon ..... F42B 12/18 102/308
(Continued)

FOREIGN PATENT DOCUMENTS

EP 1698852 9/2006
FR 2863699 6/2005
(Continued)

OTHER PUBLICATIONS

International Preliminary Report on Patentability for International Application No. PCT/US2015/021368 completed Sep. 20, 2016.
(Continued)

*Primary Examiner* — James S Bergin
(74) *Attorney, Agent, or Firm* — Joel G Landau

(57) ABSTRACT

A munition includes a composite case, a blast cone housed by the composite case, a grenade aft of the blast cone and housed by the composite case, a first attenuator forward of the blast cone, and a second attenuator aft of the blast cone and forward of the grenade.

6 Claims, 2 Drawing Sheets

(51) Int. Cl.
*F42B 12/76* (2006.01)
*F42B 3/16* (2006.01)

(58) Field of Classification Search
USPC ..... 102/308, 476, 487, 482, 483
See application file for complete search history.

(56) References Cited

U.S. PATENT DOCUMENTS

| | | | | |
|---|---|---|---|---|
| 5,107,766 | A | 4/1992 | Schliesske | |
| 5,123,612 | A * | 6/1992 | Labroche | F41G 7/222 102/476 |
| 5,780,766 | A * | 7/1998 | Schroppel | F42B 12/16 102/308 |
| 7,273,011 | B2 * | 9/2007 | Bissig | F42B 12/18 102/308 |
| 2011/0146523 | A1 | 6/2011 | Kim | |

FOREIGN PATENT DOCUMENTS

| | | |
|---|---|---|
| GB | 1605340 | 1/1992 |
| GB | 2337576 | 11/1999 |

OTHER PUBLICATIONS

International Search Report for PCT Application No. PCT/US2015/021368 completed Oct. 13, 2015.

* cited by examiner

LIGHTWEIGHT MUNITION

CROSS-REFERENCE TO RELATED APPLICATIONS

The present disclosure claims priority to U.S. Provisional Patent Application No. 61/968,092, filed Mar. 20, 2014.

BACKGROUND

Munitions, such as tandem warheads, can include two explosive charges. A forward explosive charge of the warhead detonates first at the target, and an aft explosive charge detonates after a preset delay. The blast of the forward charge initially disrupts the target such that second charge can penetrate the remaining target to cause further damage upon detonation after the delay.

SUMMARY

A munition according to an example of the present disclosure includes a composite case, a blast cone housed by the composite case, a grenade aft of the blast cone and housed by the composite case, a first attenuator forward of the blast cone, and a second attenuator aft of the blast cone and forward of the grenade.

A further embodiment of any of the foregoing embodiments includes a main charge housed in the composite case forward of the first attenuator.

In a further embodiment of any of the foregoing embodiments, the first attenuator is forward of the blast cone and aft of the main charge.

In a further embodiment of any of the foregoing embodiments, the first and second attenuators include a foam material.

In a further embodiment of any of the foregoing embodiments, the foam material is polyurethane.

In a further embodiment of any of the foregoing embodiments, the blast cone includes an internal cavity, with a third attenuator in the internal cavity.

In a further embodiment of any of the foregoing embodiments, the composite case is formed of a polymeric composite material.

In a further embodiment of any of the foregoing embodiments, the composite case is formed of a fiber-reinforced polymer matrix composite.

A munition according to an example of the present disclosure includes composite case, a blast cone housed by the composite case, an energetic device aft of the blast cone and housed by the case, a first low density urethane filler forward of the blast cone, and a second low density urethane filler between the blast cone and the energetic device.

In a further embodiment of any of the foregoing embodiments, the munition is a shoulder-launched missile.

A munition according to an example of the present disclosure includes a case having a switch at a forward end thereof, forward and aft explosive charges in the case, and first and second detonators coupled, respectively, with the forward and aft explosive charges and the switch such that the first and second detonators trigger detonation of the forward and aft explosive charges responsive to triggering of the switch. The second detonator has a detonation delay relative to the first detonator, a blast cone in the case between the forward and aft explosive charge, and a shock absorber between the forward and aft explosive charges. The shock absorber protects the aft explosive charge from a shock blast of the forward explosive charge due to the detonation delay.

In a further embodiment of any of the foregoing embodiments, the shock absorber includes a cellular material.

In a further embodiment of any of the foregoing embodiments, the shock absorber is forward of the blast cone and aft of the main charge.

In a further embodiment of any of the foregoing embodiments, the shock absorber is aft of the blast cone.

In a further embodiment of any of the foregoing embodiments, the blast cone includes an internal cavity, and the shock absorber is in the internal cavity.

In a further embodiment of any of the foregoing embodiments, the hollow body is formed of a polymeric material.

In a further embodiment of any of the foregoing embodiments, the hollow body is formed of a fiber-reinforced polymer matrix composite.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1A:
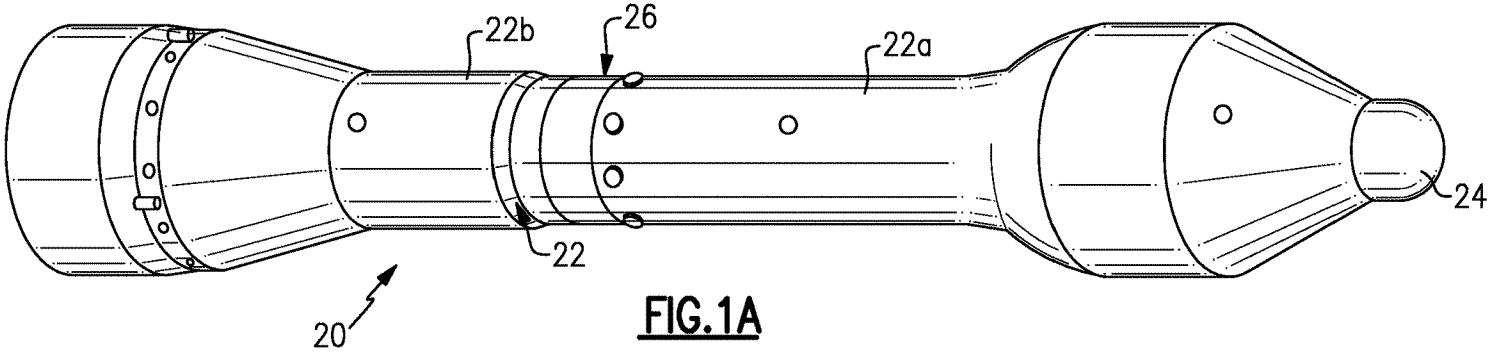
FIG. 1A illustrates a perspective view of an example munition.
Figure 1B:
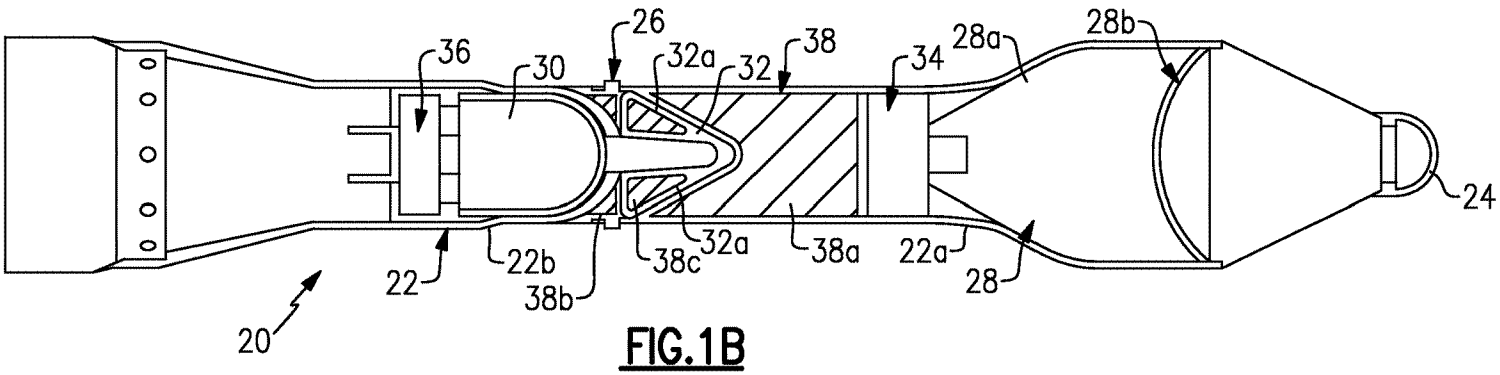
FIG. 1B illustrates a cross-sectional view of the munition of FIG. 1.

FIG. 1A illustrates a perspective view of an example munition 20, and FIG. 1B shows a cross-section along the longitudinal axis of the munition 20. Tandem warheads, such as shoulder-launched missiles, include two explosive charges. A forward explosive charge detonates first at the target, and an aft explosive charge detonates after a preset delay. A blast cone can be provided between the explosive charges to deflect the blast shock of the first explosive charge and thus protect the aft explosive charge from being damaged before detonation. As will be described in more detail, the munition 20 includes additional features to further protect the aft explosive charge from the blast shock.

The munition 20 includes a composite case or hollow body 22 having a switch 24 at a forward end thereof. In this example, the hollow body 22 is a multi-piece case and includes a forward case portion 22*a* and an aft case portion 22*b*. The case portions 22*a*/22*b* are connected at a joint 26. For example, the joint 26 can be, but is not limited to, a bolted joint. The hollow body 22 may alternatively include more than two case portions, or be provided as a single, unitary case, although the multi-piece arrangement may permit easier access to the interior.

The munition 20 further includes a main charge 28 housed in the hollow body 22 and a grenade 30 housed in the hollow body 22 aft of the main charge 28. In this regard, the main charge 28 and the grenade 30 are, respectively, forward and aft explosive charges. The main charge 28 can include, but is not limited to, a polymer-bonded explosive (represented at 28*a*) and a metallic liner 28*b*, which upon detonation form an explosively-formed penetrator.

A blast cone 32 is housed in the hollow body 22 aft of the main charge 28 and forward of the grenade 30. The blast cone 32 is physically separate from the grenade 30 so as to not impede the forward fragmentation effects of the grenade 30. The blast cone 32 can be formed of a metal or alloy for deflecting the blast shock of the main charge 28. First and second detonators 34/36 are coupled, respectively, with the main charge 28 and the grenade 30 and the switch 24, although other methods for triggering ignition may alternatively be used.

The detonators 24/36 trigger detonation of the main charge 28 and the grenade 30 in response to triggering of the switch 24. For example, the triggering can be from an electrical signal or signals generated upon crushing of the switch 24. In this regard, one or more known electric circuits can be provided in such triggering mechanisms. The second detonator 36 has a detonation delay relative to the first detonator 34 such that the blast of the main charge 28 initially disrupts a target, while the grenade 30 penetrates the remaining target to cause further damage upon detonation after the delay. Alternate examples for triggering the munition include, but are not limited to, timing and range sensing devices.

The blast cone 32 deflects the blast shock of the main charge 28. However, the munition 20 also includes one or more blast attenuators, generally represented at 38. In this example, the blast attenuator 38 includes a first blast attenuator 38*a* housed in the hollow body 22 between the main charge 28 and the grenade 30. The first blast attenuator 38 serves to weaken the blast shock and thus further protect the grenade 30. The first blast attenuator 38 may also function as a crush zone to further protect the grenade 30.

In the illustrated example, the first blast attenuator 38 is located at least forward of the blast cone 32 and aft of the main charge 30. In further examples, the blast attenuator 38 can also include a second blast attenuator 38*b* provided aft of the blast cone 32, around the grenade 30.

In additional examples, the blast cone 32 includes one or more cavities 32 within the dome shape of the cone, and the blast attenuator 38 includes a third blast attenuator 38*c* in the one or more cavities 32. Thus, depending on the level of attenuation needed, the blast attenuator 38 can be provided in any combinations of the above locations.

The blast attenuator 38 is formed of a shock-absorbing and/or dissipating material. For example, the material is a foam material. Example foam materials can include polymeric foams, such as but not limited to, polyurethane foam. In one further example, the polyurethane foam is low density polyurethane foam, to weaken the blast shock and serve as a crush zone. The foam can be pre-formed into a desired design shape to fit in the designated location, formed in-situ using a dispensed two-part foam, or combinations thereof. A dispensed foam includes two reactants that, when mixed and dispensed, react to form the final foam.

In further examples, the hollow body 22 (one or more of the multiple pieces, if used) can be formed of a composite material, to reduce weight and enhance performance. For example, the composite material is a reinforced polymer matrix composite. Example reinforced polymer matrix composites can include continuous fiber reinforced polymer matrix composites. In instances where it is desirable that the hollow body 22 not hinder the blast of the main charge or grenade 30, the fibers and matrix material can be selected with respect to known, estimated, or simulated blast energy such that the hollow body 22 essentially disintegrates to powder or small fragments that do not hinder the blast. For example, the fibers are carbon fibers and the polymer matrix is a thermoset polymer. The thermoset polymer can be epoxy, for example. Thus, the hollow body 22 is lightweight, robust to carry the charges, yet does not significantly impede the blast.

Figure 2:
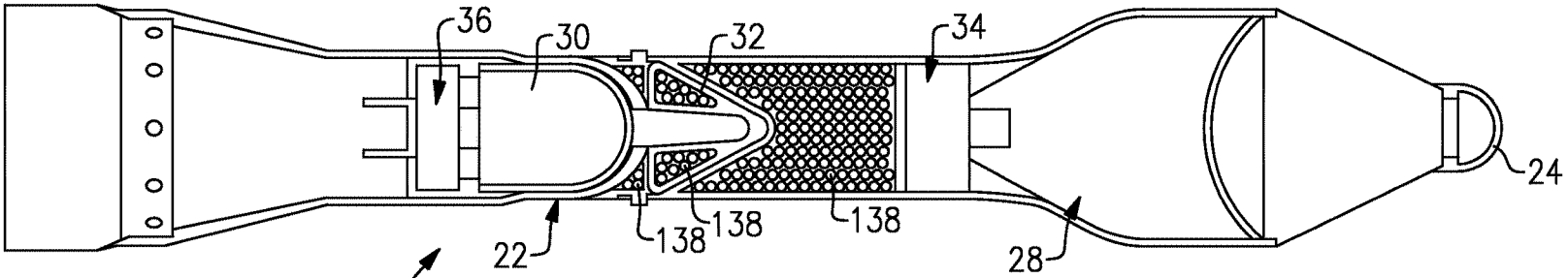
FIG. 2 illustrates another example munition.

FIG. 2 illustrates a cross-section of another example munition 120. In this disclosure, like reference numerals designate like elements where appropriate and reference numerals with the addition of one-hundred or multiples thereof designate modified elements that are understood to incorporate the same features and benefits of the corresponding elements. In this example, the munition 120 includes a shock absorber 138 between the main or forward charge 28 and the grenade or aft explosive charge 30. The shock absorber 138 protects the aft explosive charge 30 from the shock blast of the main or forward charge 28 due to the detonation delay in the second detonator 36.

The shock absorber 138 can be provided in any of the locations or combinations of locations described above with regard to the blast attenuator 38. The shock absorber 138 is a material or impact device that weakens the blast shock of the main or forward charge 28 such that the grenade or aft explosive charge 30 can more effectively penetrate the target. For example, the shock absorber 138 is primarily designed or configured to dissipate energy from the blast shock, rather than being a component that mainly serves some other function, and has a footprint that occupies a majority of, all of, or substantially all of the hollow cross-section through the case 22.

In further examples, the shock absorber 138 is a cellular material. The cells of the cellular material serve to primarily dissipate energy from the blast shock. Example cellular material can include, but is not limited to, honeycomb materials that have common cell shapes and a pattern of cells. Further examples can include ceramic or glass beads, which deflect the shock wave and reduce the shock energy via material fracture.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A munition comprising:

a composite case;

a blast cone housed by the composite case;

a grenade aft of the blast cone and housed by the composite case;

a first attenuator forward of the blast cone; and a second attenuator aft of the blast cone and forward of the grenade, wherein the first and second attenuators include a foam material, wherein the foam material is polyurethane.

2. The munition as recited in claim 1, further comprising a main charge housed in the composite case forward of the first attenuator.

3. The munition as recited in claim 2, wherein the first attenuator is forward of the blast cone and aft of the main charge.

4. The munition as recited in claim 1, wherein tine blast cone includes an internal cavity, with a third attenuator in the internal cavity.

5. The munition as recited in claim 1, wherein the composite case is formed of a polymeric composite material.

6. The munition as recited in claim 1, wherein the composite case is formed of a fiber-reinforced polymer matrix composite.

* * * * *